US007630654B2

(12) United States Patent
Takenaka

(10) Patent No.: US 7,630,654 B2
(45) Date of Patent: Dec. 8, 2009

(54) PRINTING APPARATUS

(75) Inventor: Nobuaki Takenaka, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 328 days.

(21) Appl. No.: 11/298,455

(22) Filed: Dec. 12, 2005

(65) Prior Publication Data

US 2007/0086796 A1 Apr. 19, 2007

(30) Foreign Application Priority Data

Dec. 10, 2004 (JP) ..... 2004-358377
Dec. 10, 2004 (JP) ..... 2004-358378
Dec. 10, 2004 (JP) ..... 2004-358379

(51) Int. Cl.
*G03G 15/08* (2006.01)

(52) U.S. Cl. ..... 399/27; 399/28; 399/29; 399/30; 399/60; 399/61; 399/62; 399/63; 399/64; 399/74; 399/112; 399/113; 399/223; 399/226

(58) Field of Classification Search ..... 399/12–13, 399/27–30, 60–64, 74, 112–113, 223, 226
See application file for complete search history.

(56) References Cited

U.S. PATENT DOCUMENTS 4,952,987 A * 8/1990 Takano ..... 399/28
6,029,018 A * 2/2000 Rogers et al. ..... 399/12
7,242,879 B2 * 7/2007 Kakuno et al. ..... 399/27
7,286,775 B2 * 10/2007 Utsumi et al. ..... 399/27
2003/0071726 A1 * 4/2003 Hopper et al. ..... 340/540

* cited by examiner

*Primary Examiner*—David M Gray
*Assistant Examiner*—Geoffrey T Evans
(74) *Attorney, Agent, or Firm*—Sughrue Mion, PLLC

(57) ABSTRACT

A plurality of chambers are adapted to accommodate a plurality of cartridges each containing toner to be used for printing. A mode changer is operable to change an operation mode of the printing apparatus in accordance with a combination of respective colors of toner in the cartridges accommodated in the chambers. A first detector is operable to detect a residual amount of toner in each of the cartridges. A second detector is operable to detect the respective colors of toner in the cartridges when the operation mode is changed. A controller is operable to generate an image data including a plurality of first identifiers each indicative of the residual amount of toner in one of the cartridges and a plurality of second identifiers each indicative of one of the colors of toner and associated with one of the first identifiers. A display is adapted to display the image data.

3 Claims, 6 Drawing Sheets

PRINTING APPARATUS

BACKGROUND OF THE INVENTION

The present invention relates to a printing apparatus.

As well known in the art, some of printing apparatuses perform color printing with using color toners supplied from toner cartridges. In many of printing apparatuses of this kind, the amounts of residual toners (hereinafter, referred to as residual toner amounts) in color toner cartridges are displayed in a display of a control panel to inform the operator of a timing when the color reproducibility of a color image is deteriorated or that when a toner cartridge is to be replaced.

FIG. 9 shows an example of a control panel 30 which displays residual toner amounts of toner cartridges in a display 31 disposed together with plural buttons on the upper face of the control panel 30. In the vicinity of the right side of the lower edge of the display 31, four oval indicators 32 colored respectively by CMYK (cyan, magenta, yellow and black) colors are arrayed. In the display 31 and above the four indicators 32, bar graphs respectively showing residual amounts of toners of colors indicated by the indicators are displayed. From the indicators 32 and the bar graphs, the operator can immediately recognize the residual toner amounts of the respective colors.

Some of printing apparatuses are configured so that color printing and monochrome printing are switched over in accordance with the combination of colors of toners of toner cartridges which are set in the apparatus. When four toner cartridges respectively filled with CMYK toners are set, for example, a printing apparatus of this kind operates in a color printing mode, and, when four toner cartridges filled with toners of K are set, operates in a monochrome printing mode.

When the above-mentioned method of displaying residual toner amounts is applied to a printing apparatus of this kind, in the monochrome printing mode, residual toner amounts of four toner cartridges for K are displayed respectively in the form of the bar graphs in the display 31 of the control panel 30. In this case, the colors of the toners the residual amounts of which are actually indicated by the bar graphs do not coincide with the colors of the indicators 32, whereby the operator is confused.

In order to provide the user with a message indicating that the toner cartridge is to be replaced with a new one, there is installed a residual toner amount detector which detects that there is no amount of residual toner in a toner cartridge.

Recently, in order to reduce the production cost of a printing apparatus of such a kind, there is adopted a configuration where a residual toner amount detector which is not highly accurate is installed, or that where a residual toner amount detector is not installed. Instead, an amount of consumed toner is calculated by counting the number of actually printed dots.

In both the configurations where a residual toner amount detector which is not highly accurate is installed, and where a residual toner amount detector is not installed, however, the accuracy of detecting the residual toner amount is not so high. Consequently, there is a problem in that a message indicating that the toner cartridge is to be replaced with a new one would be displayed although a considerable amount of toner remains in the toner cartridge.

It is well-known a printing apparatus in which a toner cartridge for supplying toner to a photosensitive drum is sequentially changed one by one every time when printing is performed on a unit number of sheets.

When a residual toner amount detector is not installed on such a printing apparatus, the printing apparatus cannot judge whether toner remains in a cartridge or not. In a case where a toner cartridge is sequentially changed one by one every time when printing is performed on a unit number of sheets, there is a problem in that a situation may occur where printing must be performed with using a toner cartridge in which toner is consumed up.

SUMMARY OF THE INVENTION

It is therefore an object of the invention to prevent the operator from being confused by displaying of a residual toner amount in a display even when a printing mode is switched in accordance with the combination of colors of toners charged in toner cartridges.

It is also an object of the invention to enable the actual residual toner amount to be known even in the case where a residual toner amount detector has accuracy which is not high, or where a residual toner amount detector is not installed.

It is also an object of the invention to provide a printing apparatus which enables printing with toner in only a toner cartridge in which toner remains even when a sensor for detecting the residual toner amount of a toner cartridge is not installed.

In order to achieve the above objects, according to the invention, there is provided a printing apparatus, comprising:

a plurality of chambers, adapted to accommodate a plurality of cartridges each containing toner to be used for printing;

a mode changer operable to change an operation mode of the printing apparatus in accordance with a combination of respective colors of toner in the cartridges accommodated in the chambers;

a first detector, operable to detect a residual amount of toner in each of the cartridges;

a second detector, operable to detect the respective colors of toner in the cartridges when the operation mode is changed;

a controller, operable to generate an image data including a plurality of first identifiers each indicative of the residual amount of toner in one of the cartridges, and a plurality of second identifiers each indicative of one of the colors of toner and associated with one of the first identifiers; and a display, adapted to display the image data.

With this configuration, a user is prevented from being confused by displaying of the residual toner amount in the display even when the operation mode is switched in accordance with the combination of colors of toner filled in the cartridges.

The image data may include a plurality of third identifiers each indicative of a position of one of the chambers and associated with one of the first identifiers.

The controller may be operable to calculate an average residual amount of toner in the cartridges when the second detector detects that the same color of toner is contained in all of the cartridges accommodated in the chambers. The image data may include a third identifier indicative of the average residual amount.

Each of the second identifiers may be an alphabetical character or a color of the associated one of the first identifiers.

According to the invention, there is also provided a printing apparatus, comprising:

a plurality of chambers, adapted to accommodate a plurality of cartridges each containing toner;

a print engine, adapted to perform printing on a print medium with the toner in the respective cartridges accommodated in the chambers;

a judge, determining whether it is necessary to check residual toner amounts of the respective cartridges; and a controller, operable to cause the print engine to print a test image on the print medium when the judge determines that it is necessary to check the residual toner amounts, wherein the test image includes a plurality of patterns each of which is to be located at different positions on the print medium and is associated with one of the chambers.

With this configuration, when a pattern a density of which is reduced exists in the test image, a user can judge that the actual residual toner amount in the cartridge which is loaded in the chamber corresponding to the pattern is reduced.

Therefore, it is possible to know the actual residual toner amount even in the case where a residual toner amount detector has accuracy which is not high, or where a residual toner amount detector is not installed.

The test image may include a plurality of identifiers each indicative of a position of one of the chambers and associated with one of the patterns.

The printing apparatus may further comprise a calculator, calculating a residual toner amount in each of the cartridge by counting the number of toner dots printed on the print medium. The judge may determine that it is necessary to check the residual toner amounts, when the calculated residual toner amount in at least one of the cartridges becomes lower than a prescribed value.

The printing apparatus may further comprise a detector, detecting a residual toner amount in each of the cartridge. The judge may determine that it is necessary to check the residual toner amounts, when the detected residual toner amount in at least one of the cartridges becomes lower than a prescribed value.

The judge may be activated when at least two of the chambers are occupied by the cartridges.

According to the invention, there is also provided a printing apparatus, comprising:

a plurality of chambers, adapted to accommodate a plurality of cartridges each containing toner;

a print engine, including a plurality of developing devices each of which is adapted to visualize an electrostatic latent image on an image carrier with the toner in associated one of the cartridges accommodated in the chambers;

a storage, storing a plurality of flags each of which is associated with one of the developing devices, and adapted to be switchable between an enabling state or a disabling state;

a controller, operable to drive the print engine so as to operate at least one of the developing devices that is associated with one of the flags which is in the enabling state; and a first switcher, adapted to receive an instruction from a user, and operable to switch each of the flags to one of the enabling state and disabling state.

With the above configuration, a user can set a developing device to which a cartridge having a reduced amount of toner is attached, as a developing device which cannot operate. Even when a residual toner amount detector is not installed, therefore, toner in only a cartridge in which toner remains can be used in printing.

The printing apparatus may further comprise: a detector, operable to detect that a cartridge replacement is performed at each of the chambers; and a second switcher, operable to switch at least one of the flags which is associated with one of the chambers that the cartridge replacement is detected, to the enabling state.

The printing apparatus may further comprising a judge, determining whether it is necessary to check residual toner amounts of the respective cartridges. The controller may be operable to cause the print engine to print a test image on a print medium when the judge determines that it is necessary to check the residual toner amounts. The test image may include a plurality of patterns each of which is to be located at different positions on the print medium and is associated with one of the chambers.

The test image may include a plurality of identifiers each indicative of a position of one of the chambers and associated with one of the patterns.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Embodiments of the invention will be described below in detail with reference to the accompanying drawings.

Figure 1:
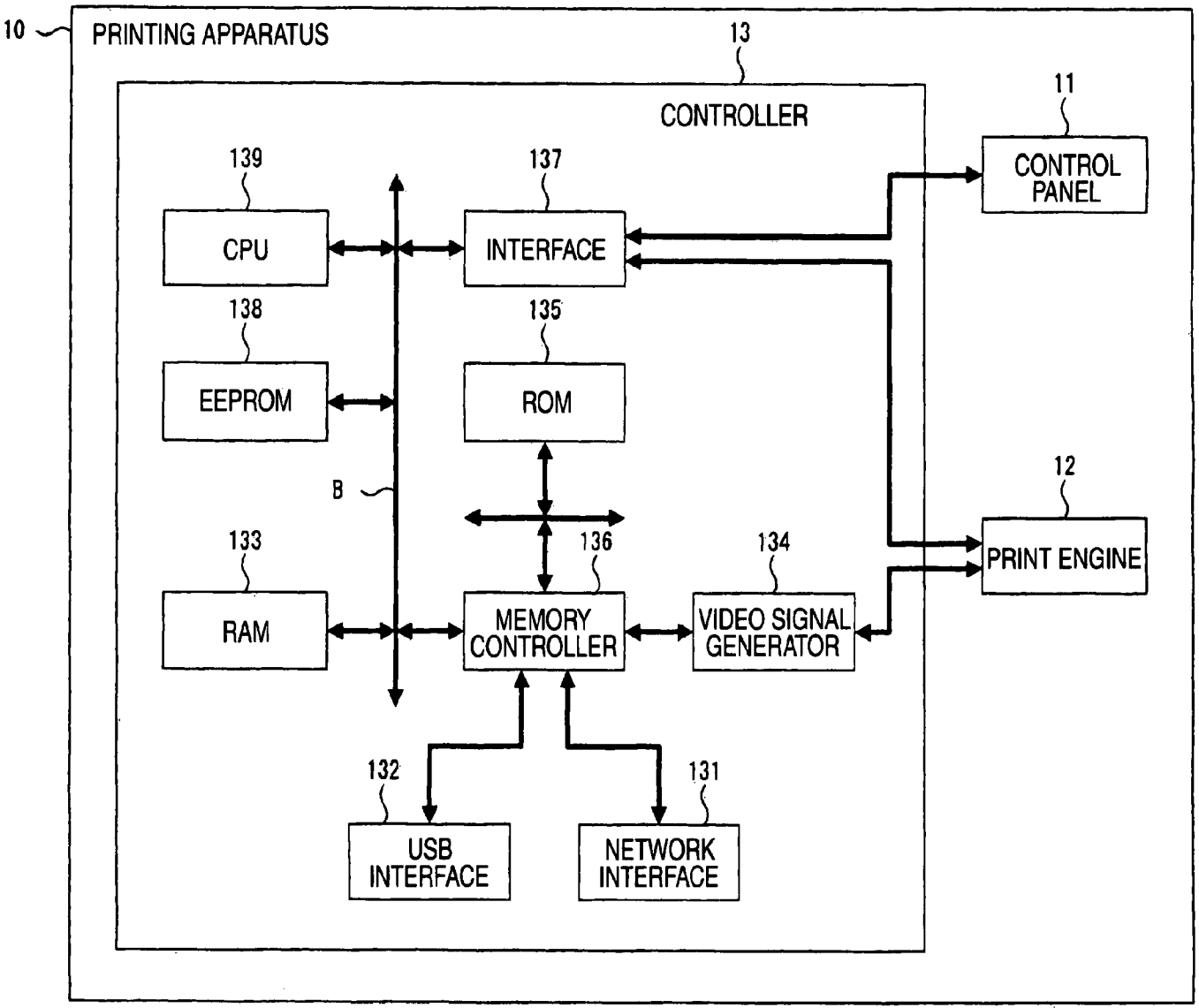
FIG. 1 is a block diagram showing an internal configuration of a printing apparatus according to a first embodiment of the invention.

A printing apparatus 10 according to a first embodiment receives a print request from a host computer which is not shown or a camera device which is not shown, and operates in response to the request. As shown in FIG. 1, the apparatus comprises a control panel 11, a print engine 12, and a controller 13.

Figure 2:
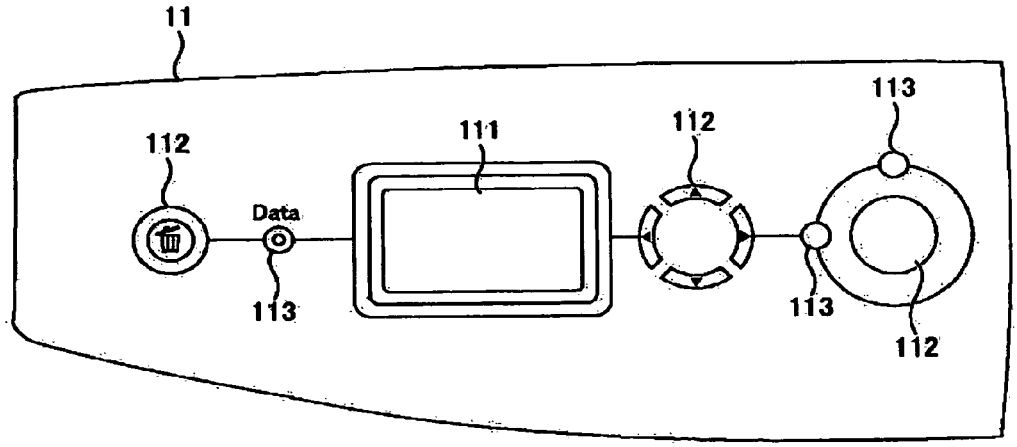
FIG. 2 is a plan view of a control panel of the printing apparatus.

The control panel 11 is a device which obtains from the operator instructions related to a process to be executed, and which is disposed in the upper face of the printing apparatus 10. As shown in FIG. 2, the upper face of the control panel 11 comprises interface components which are required in operation, such as an LCD 111, buttons 112, and LEDs 113. The interface components 111 to 113 are attached to the casing, and connected to a control circuit on a board in the control panel, via signal lines which are not shown. The board is connected to the controller 13 shown in FIG. 1 via a cable which is not shown.

The print engine 12 is a mechanism which actually performs printing on a sheet. As described later in detail, the print engine 12 can perform color printing and monochrome printing.

The controller 13 performs a process of controlling the driving of the print engine 12 on the basis of the print request from the host computer or camera device which is not shown, and various other processes on the basis of instructions obtained through the control panel 11.

As principal components, the controller 13 comprises on a printed circuit board a network interface 131, a USB interface 132, a RAM 133, a video signal generator 134, a ROM 135, a memory controller 136, an interface 137, an EEPROM 138, and a CPU 139.

The network interface 131 is a unit which receives the print request from the host computer which is not shown, and specifically a communication interface port such as a LAN board. The USB interface 132 is a unit which receives the print request from the camera device which is not shown, and specifically a communication interface port which controls data communication in accordance with the USB standard. The camera device is a device which can obtain image data of a still picture, and which is provided with a USB port, and specifically a digital still camera, a digital video camera, a camera-equipped mobile phone, or the like.

The RAM 133 is a memory which is used for temporarily storing the print request transmitted from the host computer or camera device which is not shown, and also for, based on the print request, producing print data to be supplied to the print engine 12.

The video signal generator 134 converts the print data to be supplied to the print engine 12, to an electric signal the form of which can be processed by a scanning unit 123 (see FIG. 3) in the print engine 12.

The ROM 135 is a nonvolatile memory which stores programs for controlling the printing apparatus 10, and font data that are used when print data are produced from the print request.

The memory controller 136 is a circuit for controlling: DMA transfer of the print request which is received from the host computer or camera device which is not shown, via the network interface 131 or the USB interface 132; that of the print data in the RAM 133 to the video signal generator 134; and writing of the programs and data in the ROM 135 into the RAM 133.

The interface 137 controls transmission and reception of various signals with respect to units in the control panel 11, and those of various signals with respect to units in the print engine 12.

The EEPROM 138 is a rewritable memory for recording various settings of printing, and various information relating to use results. The various information relating to use results includes the following information for each of toners which will be described later: the residual toner amount in a toner cartridge 21; an average of ratios of the number of dots which are actually printed to the total dot number of one page; and an average of the number of dots which are required in consumption of 1% of the toner amount.

The CPU 139 is a processor which integrally controls various portions in accordance with the programs installed in the ROM 135, thereby conducting a print control process which causes the print engine 12 to perform printing in accordance with the print request transmitted from the host computer or camera device which is not shown, and a process in which instructions for a process to be executed are obtained from the user through an operation on the control panel 11.

Figure 3:
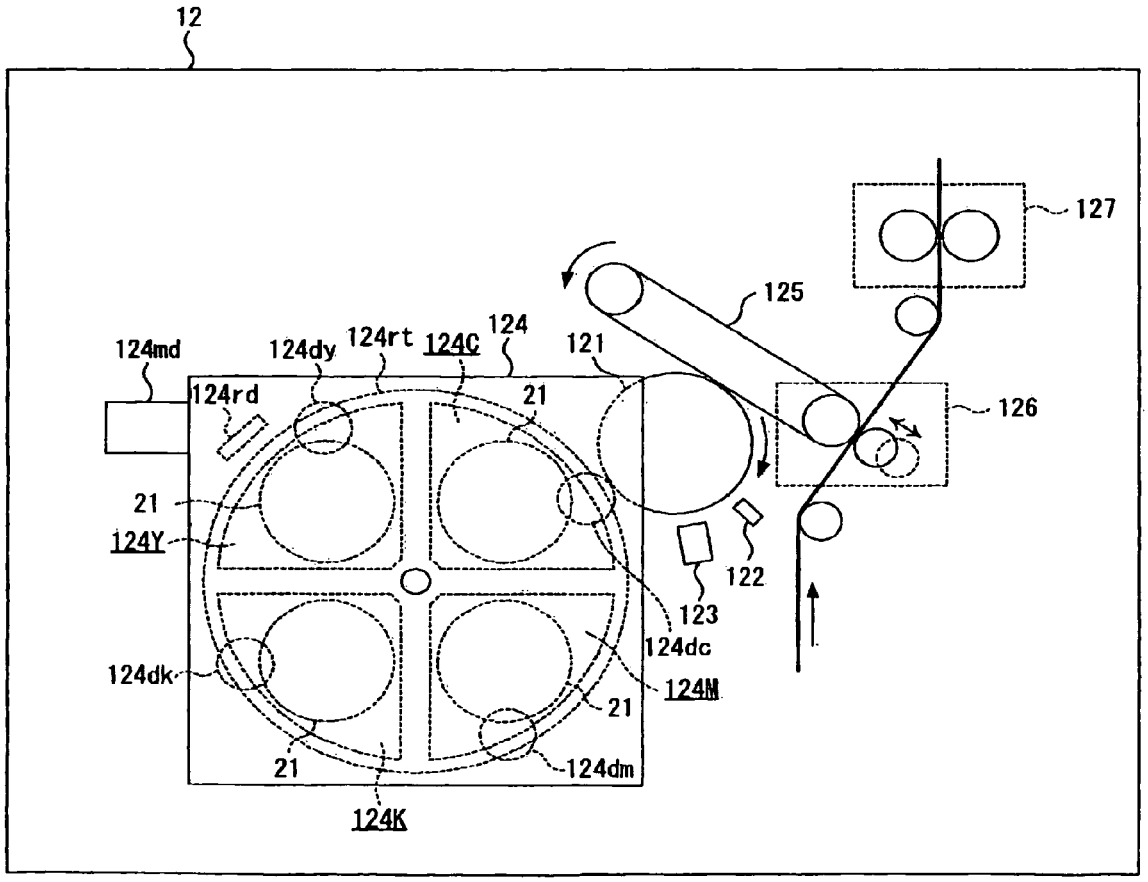
FIG. 3 is a schematic view showing the inside of the printing apparatus.

As shown in FIG. 3, the print engine 12 incorporates a photosensitive drum 121, a charging unit 122, the scanning unit 123, a rotary developing unit 124, a transfer belt unit 125, a secondary transferring unit 126, and a fusing unit 127.

The photosensitive drum 121 is a cylindrical drum in which a photoconductive material is deposited on the surface, and which is rotated about the central axis.

The charging unit 122 removes (discharges) static electricity possessed by the surface of the photosensitive drum 121, removes (cleans) toners adhering to the surface by a rubber blade or the like, and gives (charges) static electricity to the surface.

The scanning unit 123 scans the surface of the photosensitive drum 121 with a laser beam which is on/off modulated on the basis of the print data, to partially remove static electricity on the surface, thereby forming an electrostatic latent image. A signal for on/off modulating the laser beam is supplied from the video signal generator 134.

The rotary developing unit 124 conveys toner from the toner cartridge 21 to the photosensitive drum 121 in order to cause toner to adhere to the surface of the photosensitive drum 121. The configuration of the rotary developing unit 124 will be described later in detail.

The transfer belt unit 125 rotates a transfer belt which serves as an intermediate transfer medium (intermediate member), and which receives toner from the surface of the photosensitive drum 121. When color printing using color components of CMYK is to be performed, the transfer belt unit 125 performs a primary transfer process in which a toner image is transferred from the photosensitive drum 121 to the transfer belt in a superposed manner, that is, four times of transfer operations are performed for an image of one page.

The secondary transferring unit 126 is a unit which, when a toner image of one page is transferred to the transfer belt of the transfer belt unit 125, secondarily transfers the toner image to a printing sheet. The secondary transferring unit 126 comprises a clutch roller which cooperates with one roller for rotating the transfer belt to clamp the transfer roller and the sheet. When secondary transfer is not performed, the clutch roller is caused to idly rotate.

The fusing unit 127 heats toner attached to the sheet as a result of the secondary transfer, thereby fusing the toner to the sheet.

The rotary developing unit 124 incorporates a cartridge rotor 124*rt*, a CSIC reader 124*rd*, a C-developing roller 124*dc*, an M-developing roller 124*dm*, a Y-developing roller 124*dy*, a K-developing roller 124*dk*, and a motor driver 124*md*.

The cartridge rotor 124*rt* has a framework structure which is substantially cylindrical, and is rotatable about the central axis. Inside the cartridge rotor 124*rt*, cartridge chambers 124C, 124M, 124Y, 124K having a structure for loading the toner cartridge 21 which is substantially columnar are formed respectively at four symmetrical positions which have the central axis of the rotor as an axis of symmetry.

Each of the cartridge chambers 124C, 124M, 124Y, 124K comprises a sensor which, when the toner cartridge 21 is loaded, detects the residual amount of toner in the toner cartridge 21. Information indicative of the residual toner amount detected by the sensor is transmitted from the sensor to the CPU 139 through the interface 137.

The CSIC reader 124*rd* reads in a non-contact manner information recorded in a CSIC (not shown) which is installed on each of the toner cartridges 21 loaded in the cartridge chambers 124C, 124M, 124Y, 124K. The CSIC reader is placed in the vicinity of the cartridge rotor 124*rt*. The CSIC which is not shown stores information related to the color of toner charged in the toner cartridge 21 on which the CSIC is installed. The information read from the CSIC which is not shown is transmitted as color identifying information from the CSIC reader 124*rd* to the CPU 139 through the interface 137.

The four developing rollers 124*dc*, 124*dm*, 124*dy*, 124*dk* are devices which visualize an electrostatic latent image formed in the surface of the photosensitive drum 121, and incorporated at symmetrical positions in the four cartridge chambers 124C, 124M, 124Y, 124K respectively. Specifically, each of the developing rollers 124*c*, 124*dm*, 124*dy*, 124*dk* provides static electricity to toner which is in the toner cartridges 21 loaded in the corresponding one of the cartridge chambers 124C, 124M, 124Y, 124K, and which is in contact with the surface of the roller, thereby causing the toner to adhere to the surface, and rotates about the central axis to transport the toner on the surface to the photosensitive drum 121.

The motor driver 124*md* rotates the cartridge rotor 124*rt*, and controls the rotation. Specifically, the motor driver 124*md* receives information designating one of the four developing rollers 124*dc*, 124*dm*, 124*dy*, 124*dk*, from the CPU 139 through the interface 137, and then rotates the cartridge rotor 124*rt* via a motor and gear mechanism which are not shown, while monitoring the position the cartridge rotor 124*rt* by a position sensor which is not shown, whereby the designated developing roller is located at a position in the vicinity of the photosensitive drum 121.

Although not shown, the thus configured rotary developing unit 124 comprises a replacement port through which the toner cartridges 21 are removed from or inserted into the cartridge chambers 124C, 124M, 124Y, 124K. The replacement port which is not shown has a size which allows one toner cartridge 21 to be inserted into the chamber. In order to access each of the four cartridge chambers 124C, 124M, 124Y, 124K, an operation of locating the cartridge chamber at the position of the replacement port which is not shown must be conducted. The motor driver 124*md* which receives instructions from the CPU 139 rotates the cartridge rotor 124*rt* at a 90 degrees increment, thereby conducting this operation.

The printing apparatus 10 which is configured as described above operates in one of printing modes including a color mode, a 4-cartridge monochrome mode, and a 1-cartridge monochrome mode. The color mode is a printing mode where color printing is performed with using toners of color components of CMYK, and the 4-cartridge monochrome mode and the 1-cartridge monochrome mode are printing modes where black and white or monochrome printing is performed with using toners of a color component of K.

The printing mode in which the printing apparatus 10 operates depends on the color combination of toners of the toner cartridges 21 which are loaded respectively in the four cartridge chambers 124C, 124M, 124Y, 124K of the rotary developing unit 124.

Specifically, when four toner cartridges 21 respectively having toners of CMYK are loaded in the four cartridge chambers 124C, 124M, 124Y, 124K, the CPU 139 of the printing apparatus 10 determines that the printing mode is switched to the color mode, sets the printing apparatus 10 to a state where the printing apparatus can operate in the color mode, and initializes information which is recorded in the EEPROM 138 as information relating to use results.

When four toner cartridges 21 having toners of K are loaded respectively in the four cartridge chambers 124C, 124M, 124Y, 124K, the CPU 139 determines that the printing mode is switched to the 4-cartridge monochrome mode, sets the printing apparatus 10 to a state where the printing apparatus can operate in the 4-cartridge monochrome mode, and initializes information which is recorded in the EEPROM 138 as information relating to use results.

When one toner cartridge 21 having a toner of K remains to be loaded in the cartridge chamber 124K for K and the other toner cartridges 21 are removed from the cartridge chambers 124C, 124M, 124Y, the CPU 139 determines that the printing mode is switched to the 1-cartridge monochrome mode, sets the printing apparatus 10 to a state where the printing apparatus can operate in the 1-cartridge monochrome mode, and initializes information which is recorded in the EEPROM 138 as information relating to use results.

The ROM 135 stores correspondence information which, for each of the printing modes, defines correspondences between toner color(s) used in the printing mode and the cartridge chambers. On the bases of the correspondence information, the CPU 139 determines whether toner cartridges 21 of adequate colors are loaded in the cartridge chambers 124K, 124C, 124M, 124Y or not, and switches the printing mode when adequate toner cartridges 21 are loaded.

In the case where the printing mode is changed to the color mode as a result of the printing mode switching process, upon receiving a print request, the CPU 139 controls the print engine 12 so as to conduct the operation of primary-transferring the toner image from the photosensitive drum 121 to the transfer belt, four times for each image of one page as described above. Namely, the CPU 139 controls the cartridge rotor 124*rt* so as to make one rotation for one printing sheet.

In the case where the printing mode is changed to the 1-cartridge monochrome mode, upon receiving a print request, the CPU 139 controls the print engine 12 so as to use only the cartridge chamber 124K for K. In the 1 cartridge monochrome mode, the cartridge chambers 124C, 124M, 124Y which are not for K are not used.

In the case where the printing mode is changed to the 4-cartridge monochrome mode, upon receiving a print request, the CPU 139 controls the print engine 12 so as to use one of the four cartridge chambers 124K, 124C, 124M, 124Y.

Specifically, in accordance with a predetermined program in the ROM 135, the CPU 139 controls the print engine 12 so as to switch the cartridge chamber used in printing (the cartridge chamber placed in the vicinity of the photosensitive drum 121) to another one, every time when printing is performed on 15 sheets.

After printing is performed on 15 sheets, the CPU 139 performs a process of rotating the cartridge rotor 124*rt* by 90 degrees to switch the cartridge chamber to the next one. At this time, the CPU 139 judges whether the cartridge chamber to be switched as the next used one is in an enabled state or not, on the basis of flag information which is recorded in the EEPROM 138 as information of the cartridge chamber itself.

When the flag information defines that the cartridge chamber is in the enabled state, the CPU 139 causes the cartridge chamber to remain to be placed in front of the photosensitive drum 121. By contrast, when the flag information defines that the cartridge chamber is in a disabled state, the cartridge rotor 124*rt* is again rotated by 90 degrees, thereby further performing the process of switching the cartridge chamber to the next one.

When the process is performed repeatedly as required, the cartridge chamber which is defined to be in the enabled state by the flag information is placed in the vicinity of the photosensitive drum 121, and the CPU 139 is then prepared for the next print request.

Next, the contents displayed in the LCD 111 of the control panel 11 will be described.

The CPU 139 outputs information to be displayed on the LCD 111 of the control panel 11 to the control panel 11 through the interface 137. The board (not shown) in the control panel 11 produces screen data on the basis of the information supplied from the CPU 139, and causes the LCD 111 to always display the screen based on the screen data.

Figure 4:
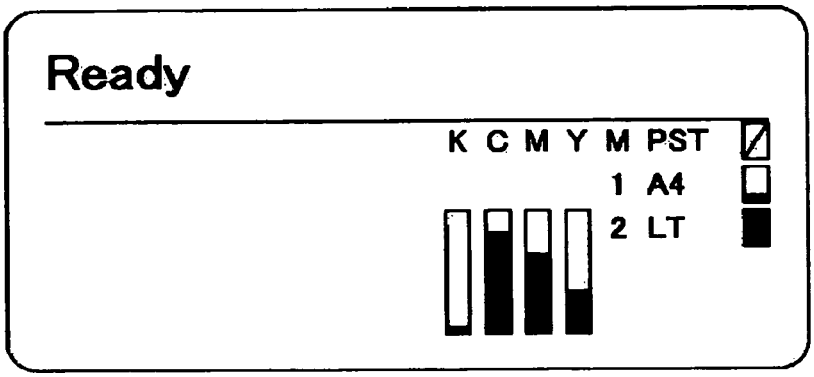
FIG. 4 is a plan view of a display in a control panel of the printing apparatus, showing a case that a color mode is selected.

FIG. 4 shows an example of the display screen of the LCD 111 in the color mode. The display screen of the LCD 111 of the control panel 11 is partitioned into upper and lower two areas. The upper area is a status display area where the operation status of the printing apparatus 10 is shown by a letter string. On the other hand, the lower area is an accessory status information display area where the residual toner amounts of the toner cartridges 21, and the size and residual amount of sheets of a sheet cassette are shown.

In the accessory status information display area, four vertical bar graphs are displayed in parallel, and letters "K", "C", "M", and "Y" are displayed above the four bar graphs, respectively.

The bar graph below the letter "K" indicates the residual toner amount of the toner cartridge 21 for K which is set in the rotary developing unit 124. The letter "K" serves as color identifying information for identifying the color component of the toner the residual amount of which is indicated by the bar graph, and also as position identifying information for identifying the cartridge chamber 124K for K in which the toner cartridge 21 for K is set.

Similarly, the bar graphs below the letters "C", "M", and "Y" indicate the residual toner amounts of the toner cartridges 21 for C, M, and Y which are set in the rotary developing unit 124, respectively. Each of the letters "C", "M", and "Y" serves as color identifying information for identifying the color component of the toner the residual amount of which is indicated by the corresponding bar graph, and also as position identifying information for identifying the cartridge chamber 124C, 124M, or 124Y In which the toner cartridge 21 for C, M, or Y is set.

In this way, the four bar graphs which are displayed on the screen correspondingly with the letters "K", "C", "M", and "Y" enable the operator to easily determine which one of the toner cartridges 21 is to be replaced with a new one.

The letters "K", "C", "M", and "Y" are displayed on the basis of the information read by the CSIC reader 124*rd*, and the bar graphs are displayed on the basis of the residual amount information read by the sensors disposed in the cartridge chambers 124C, 124M, 124Y, 124K.

Every time when a printing process is performed on one printing sheet, the CPU 139 measures the residual toner amounts in the toner cartridges 21 by the sensors, and updates the sizes of the bar graphs on the screen displayed in the LCD 111 of the control panel 11. Namely, the residual toner amounts indicated by the bar graphs are immediately updated.

Furthermore, the CPU 139 monitors switching of the printing mode in accordance with a predetermined program in the ROM 135. When it is detected that the printing mode is switched from the color mode or the 1-cartridge monochrome mode to the 4-cartridge monochrome mode, the CPU 139 instructs the control panel 11 to change the color identifying information and position identifying information which are displayed on the screen in the LCD 111 of the control panel 11.

Figure 5:
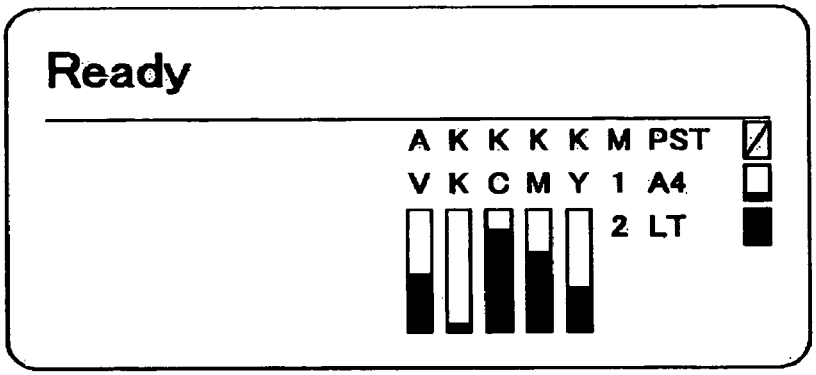
FIG. 5 is a plan view of the display in the control panel, showing a case that a 4-cartridge monochrome mode is selected.

FIG. 5 shows an example of the display screen of the LCD 111 in the 4-cartridge monochrome mode. In the same manner as the color mode, four vertical bar graphs are displayed in the accessory status information display area in the screen displayed in the LCD 111 of the control panel 11. However, the letter "K" is indicated above each of the four bar graphs, and the letters "K", "C", "M", and "Y" are indicated between the letters "K" and the bar graphs.

The bar graph designated by "K" and "K" indicates the residual toner amount of the toner cartridge 21 for K which is set in the cartridge chamber 124K for K of the rotary developing unit 124. The upper letter "K" serves as color identifying information for identifying the color component of the toner the residual amount of which is indicated by the bar graph, and the lower letter "K" serves as position identifying information for identifying the cartridge chamber 124K for K in which the toner cartridge 21 for K is set.

The bar graph designated by "K" and "C" indicates the residual toner amount of the toner cartridge 21 for K which is set in the cartridge chamber 124C for C of the rotary developing unit 124. The upper letter "K" serves as color identifying information for identifying the color component of the toner the residual amount of which is indicated by the bar graph, and the lower letter "C" serves as position identifying information for identifying the cartridge chamber 124C for C in which the toner cartridge 21 for K is set.

Similarly, the bar graph designated by "K" and "M" and that designated by "K" and "Y" indicate the residual toner amounts of the toner cartridges 21 for K which are set in the cartridge chambers 124M, 124Y for M and Y of the rotary developing unit 124, respectively. The upper letters "K" serve as color identifying information for identifying the color component of the toners the residual amounts of which are indicated by the bar graphs, and the lower letters "M" and "Y" serve as position identifying information for identifying the cartridge chambers 124M, 124Y for M and Y in which the toner cartridges 21 for K are set.

In this way, the four bar graphs which are displayed on the screen correspondingly with the letters "KK", "KC", "KM", and "KY" enable the operator to easily determine which one of the toner cartridges 21 is to be replaced with a new one.

In the 4-cartridge monochrome mode, a further one bar graph is displayed adjacent to the four bar graphs in the accessory status information display area. The bar graph indicates the average of the residual toner amounts of the four toner cartridges 21, so that it is possible to know the whole residual toner amount of the four toner cartridges 21. Letters "A" and "V" are displayed above the bar graph indicating the average of the residual toner amounts, and "AV" shows that the bar graph indicates the average of the residual toner amounts.

When it is detected that the printing mode is switched from the color mode or the 4-cartridge monochrome mode to the 1-cartridge monochrome mode, the CPU 139 instructs the control panel 11 to change the color identifying information and position identifying information which are displayed on the screen in the LCD 111 of the control panel 11.

Figure 6:
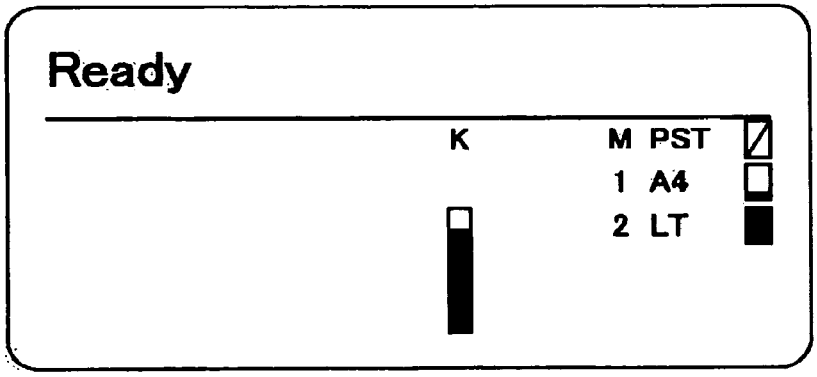
FIG. 6 is a plan view of a display in the control panel, showing a case that a 1-cartridge monochrome mode is selected.

FIG. 6 shows an example of the display screen of the LCD 111 in the 1-cartridge monochrome mode. Unlike in the color mode and the 4-cartridge monochrome mode, only one vertical bar graph is displayed in the accessory status information display area in the screen displayed in the LCD 111 of the control panel 11. The letter "K" is indicated above the bar graph.

The one bar graph indicates the residual toner amount of the toner cartridge 21 for K which is set in the rotary developing unit 124. The letter "K" serves as color identifying information for identifying the color component of the toner the residual amount of which is indicated by the bar graph, and also as position identifying information for identifying the cartridge chamber 124K for K in which the toner cartridge 21 for K is set.

In this way, the one bar graph which is displayed on the screen correspondingly with the letter "K" enables the operator to easily determine whether the toner cartridges 21 is to be replaced with a new one.

As described above, according to the printing apparatus 10 of the embodiment, even when the combination of toners charged in the toner cartridges 21 which are set in the rotary developing unit 124 is changed, respective residual toner amounts of the toner cartridges 21 used in the printing mode are displayed in the form of bar graphs on the LCD 111 of the control panel 11. Moreover, an alphabetical letter shows the residual toner amount of the color which is indicated by each of the bar graphs, and the cartridge chamber to which the toner cartridge 21 the residual toner amount of which is indicated is set. Therefore, the operator is not confused.

In the above-described embodiment, the alphabetical characters "K", "C", "M", and "Y" are used as the color identifying information and the position identifying information which are to be displayed on the LCD 111. However, symbols indicating such colors may be used. Alternatively, the bar graphs themselves are colored in KCMY, respectively, so that the color identifying information and the position identifying information are indicated by the colors of the bar graphs.

Next, a second embodiment of the invention will be described. Similar components to those in the first embodiment will be designated by the same reference numerals and repetitive explanations for those will be omitted.

In the embodiment, the cartridge chambers 124K, 124C, 124M, 124Y are not provided with a sensor which directly detects the residual toner amount in the corresponding toner cartridge 21.

As described above in connection with the first embodiment, as information relating to use results, the EEPROM 138 stores: an average of ratios of the number of dots which are actually printed to the total dot number of one page; an average of the number of dots which are required in consumption of 1% of the toner amount; and the residual toner amounts in the toner cartridges 21 which are set in the rotary developing unit 124. These sets of information are calculated by the CPU 139 in accordance with a predetermined program in the ROM 135, every time when a printing process is performed on one printing sheet. Particularly, the information related to the residual toner amounts in the toner cartridges 21 is obtained on the basis of the toner use amount calculated from the number of dots which are actually printed, and is not obtained by direct detection of the actual residual toner amounts in the toner cartridges 21 by a sensor or the like.

In accordance with another program in the ROM 135 different form the above-mentioned program, the CPU 139 monitors the residual toner amounts obtained from the actually printed dot number. When the residual toner amount of one of the toner cartridges 21 falls below a predetermined threshold, the CPU starts the process described below.

From the ROM 135 which stores image data respectively corresponding to the cartridge chambers 124K, 124C, 124M, 124Y, the CPU 139 reads the image data into the RAM 133. Thereafter, the CPU causes the cartridge chamber 124K for K to be placed in front of the photosensitive drum 121, and the image data corresponding to the cartridge chamber 124K for K to be supplied from the RAM 133 to the video signal generator 134. When the toner cartridge 21 is loaded in the cartridge chamber 124K for K at this time, a toner image is formed on the photosensitive drum, and the toner image is primary-transferred to the transfer belt.

Then, the CPU 139 causes the cartridge chamber 124C for C to be placed in front of the photosensitive drum 121, and the image data corresponding to the cartridge chamber 124C for C to be supplied from the RAM 133 to the video signal generator 134. When the toner cartridge 21 is loaded in the cartridge chamber 124C for C at this time, a toner image is formed on the photosensitive drum, and the toner image is primary-transferred to the transfer belt.

Furthermore, the CPU 139 executes a process similar to the above on the cartridge chamber 124M for M and the cartridge chamber 124Y for Y.

In the print engine 12, the toner images transferred to the transfer belt are secondary-transferred to a printing sheet by the secondary transferring unit 126, and then fusion-bonded to the printing sheet by the fusing unit 127. As a result, the printing sheet on which the test pattern image is printed is discharged from the printing apparatus 10.

Figure 7:
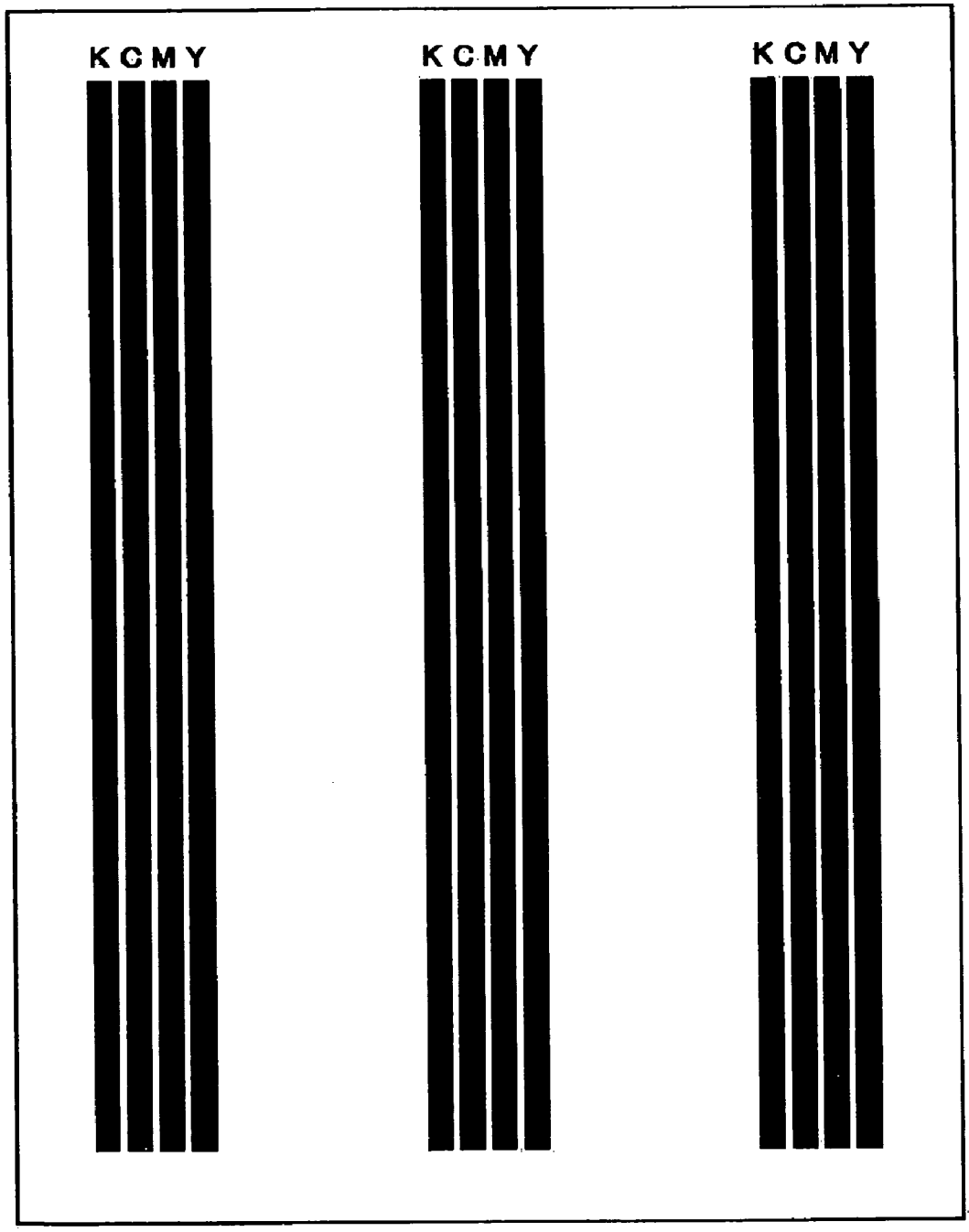
FIG. 7 is a plan view of a test pattern image printed by a printing apparatus according to a second embodiment of the invention, when a 4-cartridge monochrome mode is selected.

FIG. 7 shows an example of the test pattern image which is printed on a printing sheet by the print engine 12 in the color mode or the 4-cartridge monochrome mode. It is assumed that the vertical direction of this figure coincides with that of the test pattern image. In each of the vicinity of the left edge, the middle portion, and the vicinity of the right edge of the test pattern image, a combination of four linear reference images and letters "K", "C", "M", and "Y" is placed.

Among the four linear reference images, the first reference image is an image colored only by the same color as the toner of the toner cartridge 21 loaded in the cartridge chamber 124K Above the reference image, letter "K" is placed as identifying information for identifying the cartridge chamber 124K in which the toner cartridge 21 is loaded. The letter "K" and the reference image corresponding to the letter are reproduced on the basis of the image data which are recorded in the ROM 135 as data corresponding to the cartridge chamber 124K for K.

The second reference image is an image colored only by the same color as the toner of the toner cartridge 21 loaded in the cartridge chamber 124C. Above the reference image, letter "C" is placed as identifying information for identifying the cartridge chamber 124C in which the toner cartridge 21 is loaded. The letter "C" and the reference image corresponding to the letter are reproduced on the basis of the image data which are recorded in the ROM 135 as data corresponding to the cartridge chamber 124C for C.

Similarly, each of the third and fourth reference images is an image colored only by the same color as the toner of the toner cartridge 21 loaded in the cartridge chamber 124M or 124Y Letters "M" and "Y" are placed above the reference images, respectively. The letter "M" and the reference image corresponding to the letter are reproduced on the basis of the image data which are recorded in the ROM 135 as data corresponding to the cartridge chamber 124M for M. The letter "Y" and the reference image corresponding to the letter are reproduced on the basis of the image data which are recorded in the ROM 135 as data corresponding to the cartridge chamber 124Y for Y.

Since the test pattern image is configured in this way, each of the four linear reference images is printed with using toner of the toner cartridge 21 loaded in the corresponding cartridge chamber. When the printing mode is the color mode, therefore, four lines respectively colored in KCMY are drawn in each of the vicinity of the left edge, the middle portion, and the vicinity of the right edge of the printing sheet. When the printing mode is the 4-cartridge monochrome mode, four lines colored in K are drawn in each of the vicinity of the left edge, the middle portion, and the vicinity of the right edge of the printing sheet.

Figure 8:
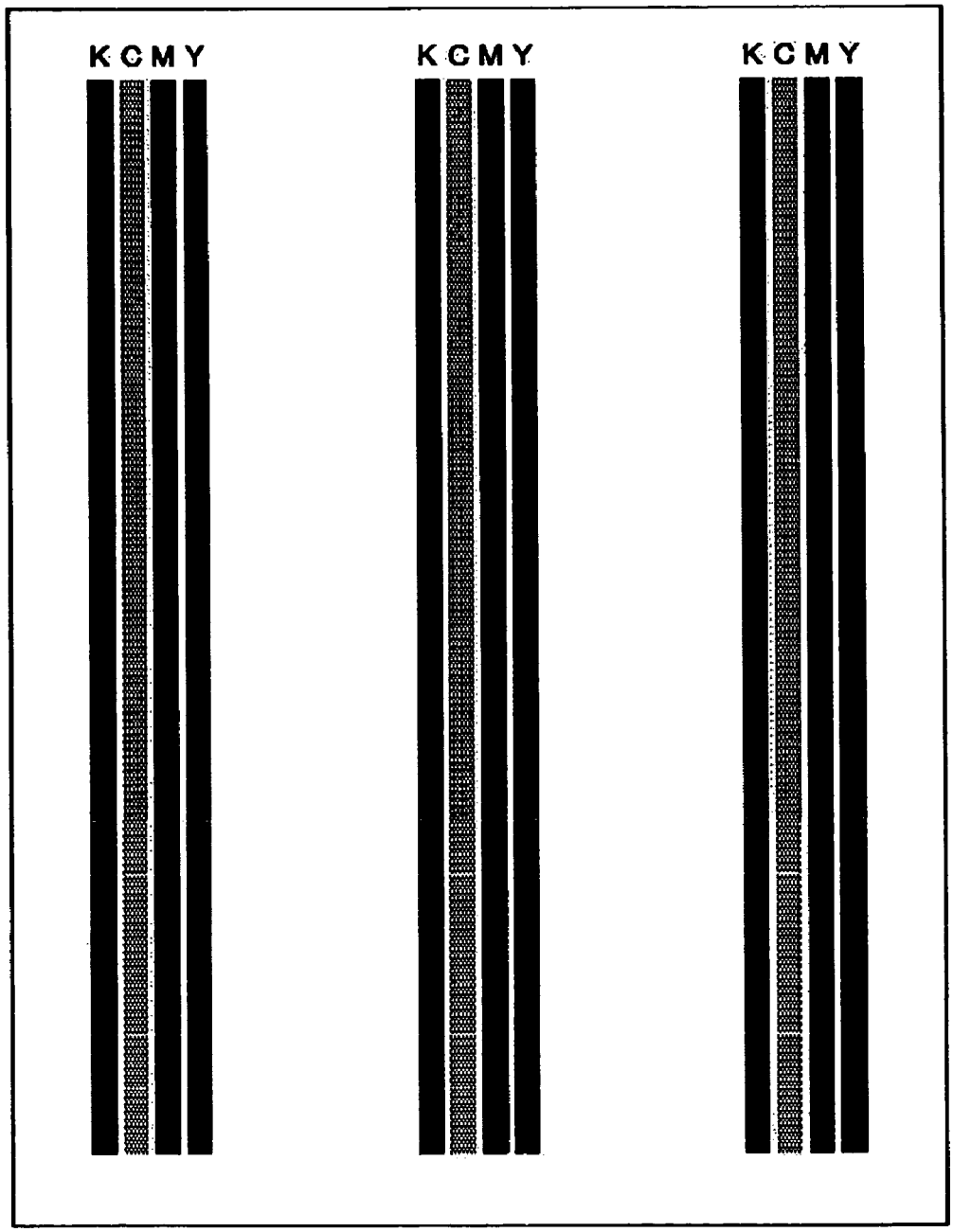
FIG. 8 is a plan view of the test pattern image, showing a case that a residual toner amount in a toner cartridge loaded in a cartridge chamber for cyan is lower than a prescribed value.
Figure 9:
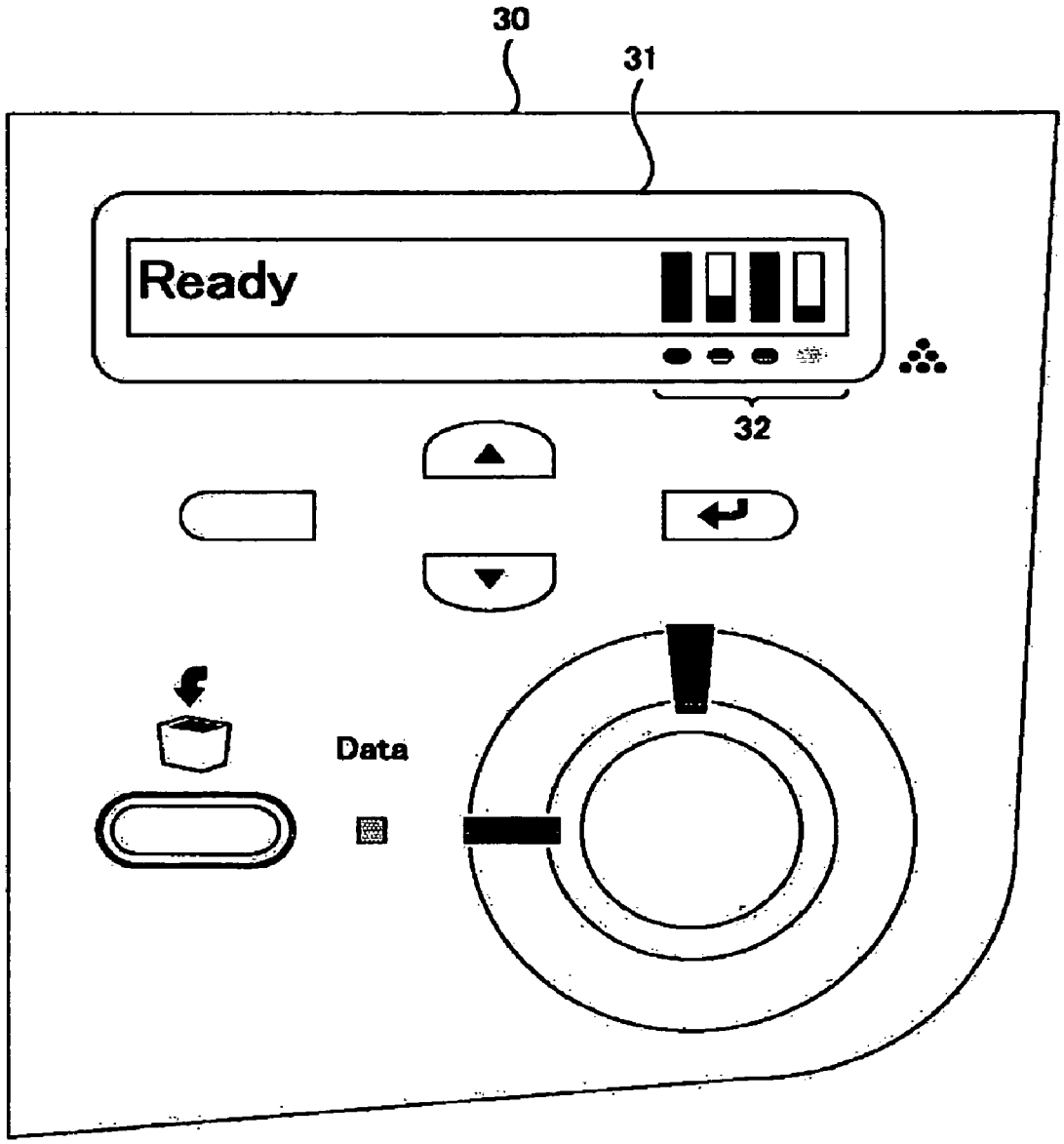
FIG. 9 is a plan view of a display in a control panel of a related-art printing apparatus.

For example, the case where the residual toner amount of the toner cartridge 21 loaded in the cartridge chamber 124C for C is actually reduced in the 4-cartridge monochrome mode will be considered. As shown in FIG. 8, on the printing sheet on which the test pattern image is printed, only the density of the reference image corresponding to letter "C" is lowered, and the reference images corresponding to letters "K", "M", and "Y" remain to have the normal density.

On the other hand, even in the case where the residual toner amounts recorded in the EEPROM 138 fall below the above-mentioned predetermined threshold, when the actual residual toner amounts are large, all the reference images in the test pattern image printed on the printing sheet remain to have the normal density.

The printing apparatus 10 of the embodiment serves as described above. Therefore, the user can refer the test pattern image on the printing sheet which is automatically printed out by the printing apparatus 10 when the residual toner amount falls below the predetermined threshold, whereby the user is enabled to easily determine the presence or absence of a toner cartridge 21 in which the residual toner amount is actually reduced, and the cartridge chamber in the rotary developing unit 124 in which the residual toner amount-reduced toner cartridge 21 is loaded.

Namely, when the user finds a reference image in which the density is lowered in the test pattern image on the printing sheet, the user can know that the toner amount of the toner cartridge 21 in the cartridge chamber indicated by the letter corresponding to the reference image in which the density is lowered is reduced.

Although it is not specifically shown in the accompanying drawings, in the 1-cartridge monochrome mode, three linear reference images colored in K are printed in the vicinity of the left edge, the middle portion, and the vicinity of the right edge of a printing sheet, respectively. This is produced because of the following reason. Since the toner cartridges 21 are not loaded in the cartridge chambers 124C, 124, 124Y for C, M, and Y, the reference images and chamber identifying information based on the image data corresponding to the cartridge chambers 124C, 124M, 124Y are not visualized. Also in the 1-cartridge monochrome mode, when a part or whole of the reference images on the printing sheet is blurred or discolored, the user can know that the toner amount of the toner cartridge 21 in the cartridge chamber 124K for K is reduced.

In this embodiment, when, in the residual toner amounts recorded in the EEPROM 138, the residual toner amount of one of the toner cartridges 21 falls below the predetermined threshold, the test pattern image is printed. This is because the toner is wastefully used if the test pattern image is printed while a sufficient amount of toner remains.

In the embodiment, when one of the residual toner amounts recorded in the EEPROM 138 falls below the predetermined threshold, the test pattern image is printed. However, a sensor for detecting the residual toner amount in the toner cartridge 21 may be attached to each of the cartridge chambers 124K, 124C, 124M, 124Y, and the test pattern image may be printed when one of the residual toner amounts detected by the sensors falls below a predetermined threshold. In this case, even when the accuracies of the residual toner amount detectors are somewhat poor, the user can easily determine whether the toner cartridge 21 in which the amount of toner is actually reduced, based on the test pattern image on a printing sheet.

In the embodiment, as shown in FIGS. 7 and 8, the combination of reference images and letters is printed in each of the three places or the vicinity of the left edge, the middle portion, and the vicinity of the right edge of the printing sheet, because it can be determined whether the distribution of toner in the toner cartridge 21 is even or not. Namely, when the density of the reference image(s) of the same cartridge chamber in one or two of the three places is lowered and that of the reference image(s) of the other place(s) remains unchanged, the user can determine that the distribution of toner in the toner cartridge 21 which is loaded in the cartridge chamber is uneven.

In the embodiment, alphabetical letters "K", "C", "M", and "Y" are correspondent to the reference images as the chamber identifying information for identifying the cartridge chambers 124K, 124C, 124M, 124Y. However, these letters are not necessary because of the following reasons. In the color mode, the colors themselves which color the reference images function as the chamber identifying information for identifying the cartridge chambers, In the 4-cartridge monochrome mode, when the arrangement order of the reference images and the order of the cartridge chambers are once defined, the arrangement order of the reference images functions as the chamber identifying information for identifying the cartridge chambers.

The user recognizes the cartridge chamber where the toner cartridge 21 in which the residual toner amount is actually reduced is loaded, as a result of the printing of the test pattern image. In order to prevent the toner cartridge 21 in the cartridge chamber from being used in printing, thereafter, the user sets the cartridge chamber to be disabled from being used.

Specifically, in the example of FIG. 8, the user operates the control panel 11 to change the flag information of the cartridge chamber 1240 for C from the enabled state to the disabled state. The changing operation causes the flag information which is recorded in the EEPROM 138 as information of the cartridge chamber 124C for C, to be overwritten from "1" indicative of the enabled state to "0" indicative of the disabled state.

As a result, in the 4-cartridge monochrome mode, the group of cartridge chambers which can be switched every time when printing is performed on 15 sheets is configured by the three cartridge chambers 124K, 124M, 124Y for K, M, and Y. The cartridge chamber 124C for C is eliminated from the group of cartridge chambers.

In this embodiment, three cartridge chambers can be set at the maximum to the disabled state. When three cartridge chambers are set to the disabled state, only the toner cartridge 21 loaded in the remaining single cartridge chamber supplies toner of K In this case, namely, the embodiment operates in the same manner as in the 1-cartridge monochrome mode.

As described above, according to the printing apparatus 10 of the embodiment, in the 4-cartridge monochrome mode in which toner of the same color is loaded in the cartridge chambers 124K, 124C, 124M, 124Y, the enabled cartridge chamber(s) and the disabled cartridge chamber(s) are defined by the flag information in the EEPROM 138, and the flag information can be changed by the user. Therefore, the user can cause the test pattern image to be printed, check a cartridge chamber where a toner cartridge in which the residual toner amount is reduced is loaded, and thereafter set the cartridge chamber to the disabled state. Even when a residual toner amount detector is not installed, therefore, toner in only a toner cartridge in which toner remains can be used in printing.

The above-described printing apparatus may be configured so that, when replacement of the toner cartridge 21 is conducted on the cartridge chamber which is defined to be in the disabled state by the flag information in the EEPROM 138, the contents of the flag information corresponding to the cartridge chamber is reset to the enabled state.

Specifically, with using a sensor (not shown) for detecting opening and closing of an outer cover which covers the replacement port (not shown), and the CSIC reader 124*rd*, the CPU 139 of the printing apparatus 10 monitors whether replacement of the toner cartridge 21 is performed on one of the cartridge chambers. When replacement of the toner cartridge 21 is performed on one of the cartridge chambers, the CPU determines whether the flag information which is recorded in the EEPROM 138 as information corresponding to the cartridge chamber defines the disabled state or not. If the flag information defines the disabled state, the CPU 139 resets the flag information by overwriting the contents to those indicative of the enabled state.

With this configuration, when the toner cartridge 21 is replaced because the residual toner amount is reduced, it is possible to save the trouble of manually (on the control panel 11) resetting to the enabled state the contents of the flag information relating to the cartridge chamber on which the replacement of the toner cartridge 21 is performed.

In the above embodiments, the developing sections are incorporated in a rotor so that one of the developing sections is selectively confronted with the photosensitive drum. However, the printing apparatus of the invention may be configured such that a plurality of developing sections may be arranged around a single photosensitive drum so that developed toner images are superposed on the photosensitive drum. Alternatively, the printing apparatus may be configured such that a plurality of developing sections are disposed on respectively corresponding photosensitive drums to configure a so-called tandem print engine.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A printing apparatus, comprising:

a plurality of chambers, adapted to accommodate a plurality of cartridges each containing toner to be used for printing;

a mode changer, operable to change an operation mode of the printing apparatus in accordance with a combination of respective colors of toner in the cartridges accommodated in the chambers;

a first detector, operable to detect a residual amount of toner in each of the cartridges;

a second detector, operable to detect the respective colors of toner in the cartridges when the operation mode is changed;

a controller, operable to generate an image data including a plurality of first identifiers each indicative of the residual amount of toner in one of the cartridges, and a plurality of second identifiers each indicative of one of the colors of toner and associated with one of the first identifiers; and a display, adapted to display the image data, wherein the controller is operable to calculate an average residual amount of toner in the cartridges when the second detector detects that the same color of toner is contained in all of the cartridges accommodated in the chambers;

wherein the image data includes a third identifier indicative of the average residual amount; and wherein the third identifier can be displayed simultaneously with the first and second identifiers.

2. The printing apparatus as set forth in claim 1, wherein the image data includes a plurality of third identifiers each indicative of a position of one of the chambers and associated with one of the first identifiers.

3. The printing apparatus as set forth in claim 1, wherein each of the second identifiers is an alphabetical character.

* * * * *